US005106013A

United States Patent [19]

Southwell et al.

[11] Patent Number: 5,106,013

[45] Date of Patent: Apr. 21, 1992

[54] SHIPPING CONTAINER FOR A BOOK AND BLANK THEREFOR

[75] Inventors: James D. Southwell, Palatine, Ill.; Herbert A. Patterson, Creston, Ohio

[73] Assignee: Packaging Corporation of America, Evanston, Ill.

[21] Appl. No.: 713,686

[22] Filed: Jun. 11, 1991

[51] Int. Cl.[5] ..... B65D 5/54

[52] U.S. Cl. ..... 229/40; 229/223; 229/242

[58] Field of Search ..... 229/40; 206/424, 611

[56] References Cited

U.S. PATENT DOCUMENTS

| | | | |
|---|---|---|---|
| 3,064,875 | 11/1962 | Mairs | 206/424 |
| 3,110,435 | 11/1963 | Layne, Sr. | 229/40 |
| 3,219,256 | 11/1965 | Zastrow | 229/40 |
| 3,325,964 | 6/1967 | Boitel | 229/40 |
| 3,826,362 | 7/1974 | Staskus | 229/40 |
| 4,090,608 | 5/1978 | McCall | 229/40 |
| 4,215,780 | 8/1980 | Carlson | 229/40 |
| 4,396,118 | 8/1983 | Watson | 229/40 |

*Primary Examiner*—Gary E. Elkins
*Attorney, Agent, or Firm*—Leydig, Voit & Mayer

[57] ABSTRACT

A shipping container for a book is provided formed from a single blank of foldable sheet material. The container includes top and bottom major panels, opposed side minor panels, end wall assemblies foldably connected to opposite ends of one major panel, and closure panels foldably connected to opposite ends of the other major panel. First tuck flaps are foldably connected to opposite ends of one side panel. Each closure panel has a foldable second tuck flap extending laterally from one side thereof. Each assembly includes a narrow first panel foldably connected to the one major panel, a second panel foldably connected to the first panel, and a narrow third panel foldably connected to the second panel. The first, second and third panels are arranged in side by side relation. The first panel is folded under the one major panel, and the second panel spans the distance therebetween, and engages an adjacent end surface of the book. The third panel engages the concealed surface of the other major panel. Each closure panel extends between corresponding ends of the major panels and is spaced outwardly from the assembly second panel and cooperates therewith to form a cavity disposed outwardly of the adjacent book end surface. The second tuck flap of each closure panel extends into the cavity and has an edge proximate the assembly second panel. Each first tuck flap extends into the adjacent cavity. The second tuck flaps span the distance between the first and third panels forming the adjacent cavity.

9 Claims, 2 Drawing Sheets

Fig. 3
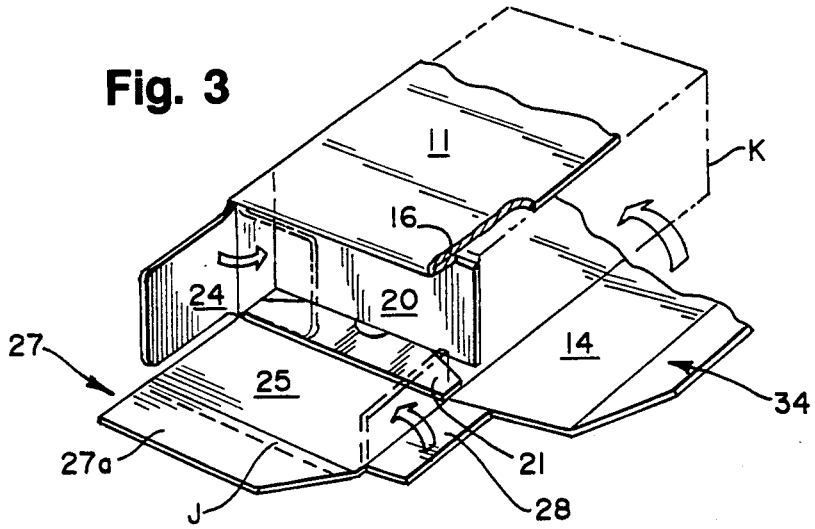
Fig. 4
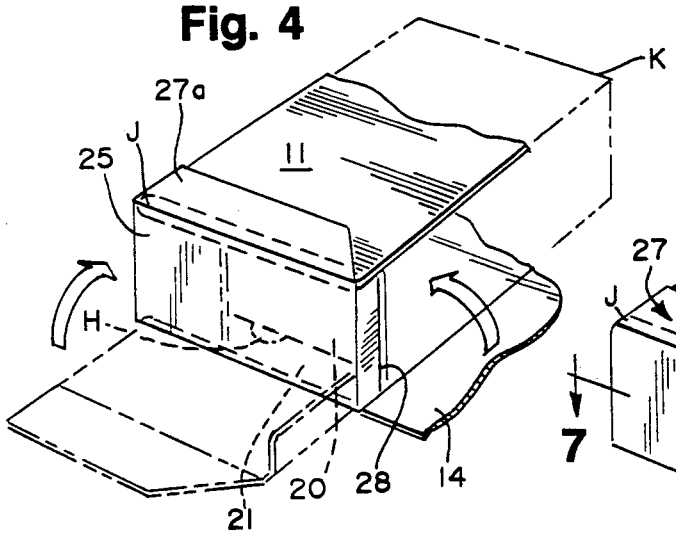
Fig. 5
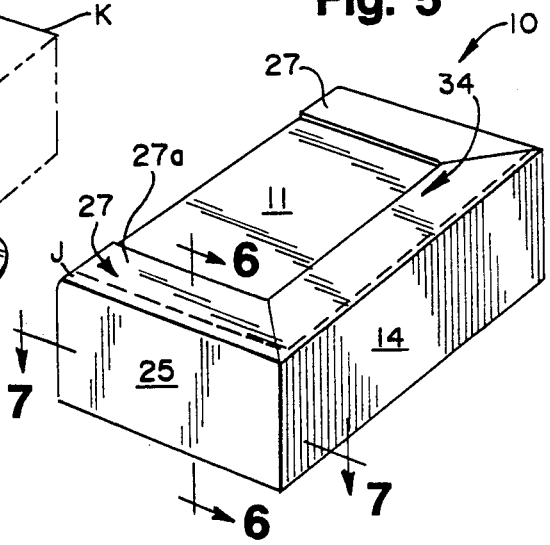
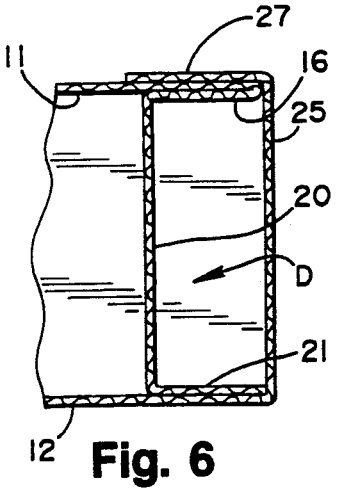
Fig. 6
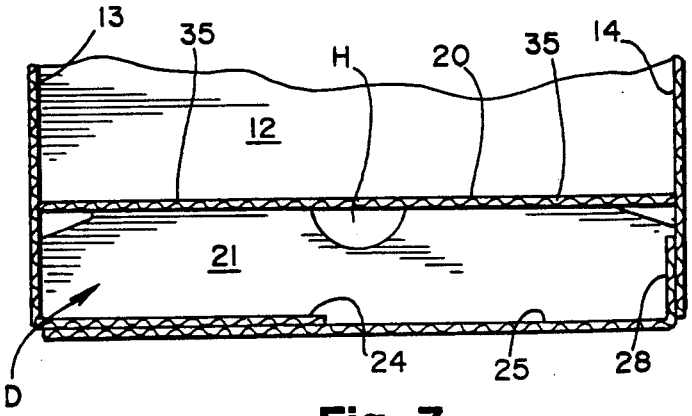
Fig. 7

SHIPPING CONTAINER FOR A BOOK AND BLANK THEREFOR

BACKGROUND OF THE INVENTION

Protecting a bound book or an article having a similar configuration when packaged for shipping or mailing to a customer has always presented a problem because of the abusive handling to which such package is frequently subjected. Because of the current high purchase price of bound books, the customer will not accept such books if the exterior thereof has been defaced or damaged. Thus, in such a situation the seller must either refund to the customer the purchase price and shipping costs, or replace the damaged book. In either case, the seller incurs a loss and oftentimes a frustrated or dissatisfied customer.

Various shipping containers for books have heretofore been utilized; however, such containers are beset with one or more of the following shortcomings; they a) are of complex, costly construction; b) are difficult and awkward to set up; c) require an inordinate amount of time and manual effort to set up; and d) provide inadequate protection to the accommodate book, particularly at the corners thereof which are most vulnerable in the event the loaded container is dropped or subjected to crushing force during handling.

SUMMARY OF THE INVENTION

Thus, an improved shipping container for a book or the like has been provided which readily overcomes the aforenoted shortcomings besetting prior book shipping containers.

The improved shipping container, while in a flat, unfolded condition may be readily stored or shipped in bulk to the printer, bookbinder or retailer.

The improved shipping container may be sized to accommodate a variety of books, the size and shape of which may vary over a wide range.

The improved shipping container is formed of a single blank of inexpensive foldable sheet material, such as corrugated fibreboard, which may be set up with a book in an expeditious, facile manner.

Additional advantages possessed by the improved shipping container will become apparent from the description, accompanying drawings and appended claims.

In accordance with one embodiment of the invention, a book shipping container has been provided which is formed from a single blank of foldable sheet material. The container includes top and bottom panels which supportingly engage, respectively, the exposed top (front) and bottom (back) surfaces of the accommodated book. Foldably connected to the top and bottom panels are opposed side panels which supportingly engage the book side surfaces. A pair of end wall assemblies is foldably connected to opposite ends of the top panel. A pair of closure panels is foldably connected to opposite ends of the bottom panel. Each end wall assembly includes a narrow first panel foldably connected to an adjacent end of the top panel, a second panel foldably connected to the first panel, and a narrow third panel foldably connected to the second panel. When the book is accommodated in the set up container, the first panel of each end wall assembly is folded back under the top panel, the second panel supportingly engages an adjacent end surface of the book and is disposed substantially transverse to the top and bottom panels, and the third panel is in substantially face to face engagement with a concealed surface of the bottom panel. One side panel is provided with foldable first tuck flaps disposed at opposite ends thereof. Each closure panel has a second tuck flap foldably connected to one side edge thereof. Retaining flaps are foldably connected to the closure panels and the second side panel and are secured to the exposed surface of the top panel, when the container is set up. Each end wall assembly and corresponding closure panel cooperate with one another to form a cavity which is disposed endwise of the adjacent end surface of the accommodated book. Each second tuck flap extends into the adjacent cavity and has an edge thereof proximate the end wall assembly second panel forming a portion of the adjacent cavity. Each second tuck flap substantially spans the distance between the first and third panels forming the adjacent cavity and provides reinforcement at the corners of the container joined by the second side panel and the closure panels.

DESCRIPTION

For a more complete understanding of the invention, reference is made to the drawings wherein:

FIGS. 2–4 are perspective views of the blank of FIG. 1 shown in successive stages of set up.

FIG. 5 is a perspective view of the improved container loaded and ready for shipment.

FIGS. 6 and 7 are enlarged fragmentary sectional views taken along lines 6—6 and 7—7 of FIG. 5.

Figure 1:
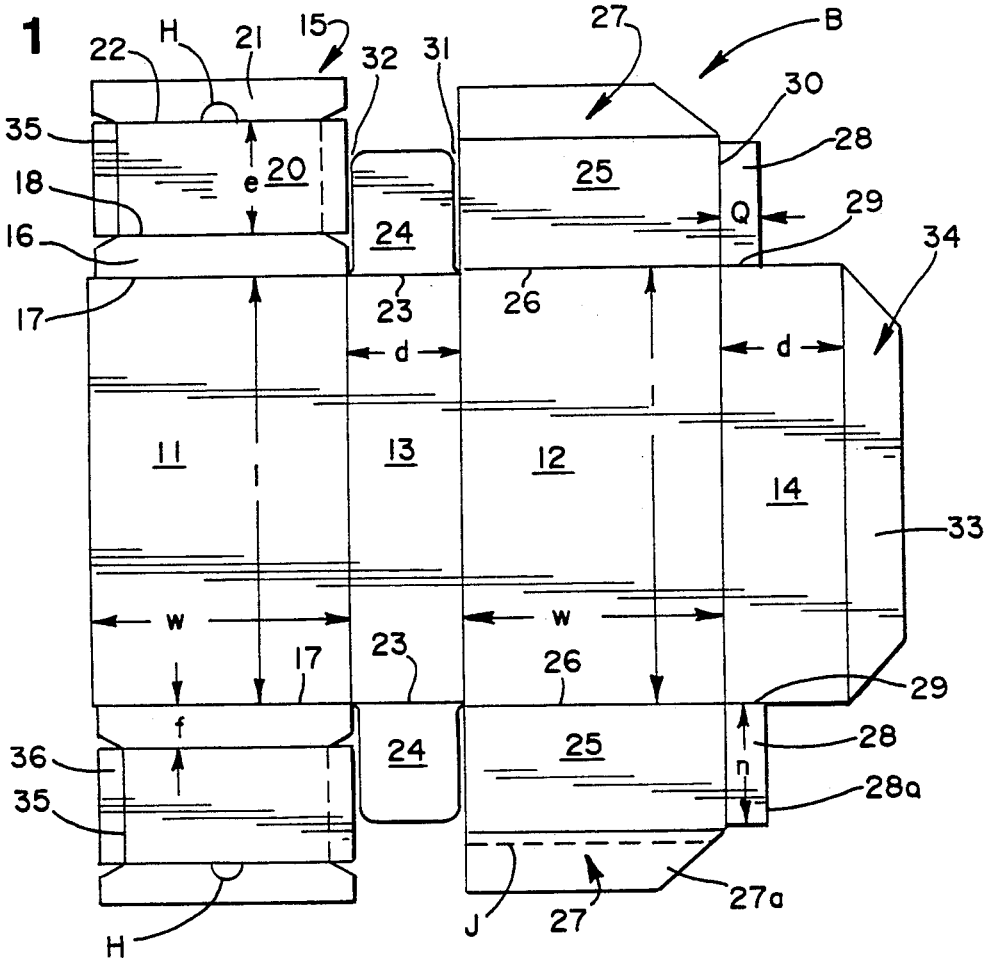
FIG. 1 is a top plan view of a blank for one embodiment of the improved shipping container.

Referring now to the drawings and more particularly to FIG. 5, one embodiment of the improved book shipping container 10 is shown loaded and ready for shipment to the book purchaser. FIG. 1 shows a blank B from which the container 10 is formed. Blank B is formed from a single sheet of inexpensive foldable material (e.g., double-faced corrugated fibreboard). The size and shape of the blank and the type of blank material utilized will depend upon the size, shape and weight of the book K, shown in the phantom lines in FIG. 2, being packaged.

Blank B as shown in FIG. 1 includes a top, or major, panel 11 and a bottom, or major, panel 12 foldably interconnected to and separated by a first side, or minor, panel 13. Foldably interconnected to the bottom panel and disposed opposite the first side panel is a second side, or minor, panel 14. The width "d" of each side panel 13, 14 corresponds substantially to the thickness 'T" of the book K to be accommodated in the container 10 plus allowances for thickness of container material. The width "w" of both the top and bottom panels 11, 12 corresponds substantially to the width "W" of the book K plus allowances for thickness of the container material, see FIG. 2.

Foldably connected to opposite ends of the top panel 11 are end wall assemblies 15. Each assembly is of like configuration and includes a narrow first panel 16 connected by a foldline 17 to the corresponding end edge of the top panel. Connected by foldline 18 to the opposite side of the narrow first panel 16 is a second panel 20. A narrow third panel 21 is connected by foldline 22 to the opposite side of second panel 20. The dimension "e" between foldline 18 and 22 corresponds substantially to the thickness "T" of book K. The dimension "f" of the narrow panels 16 and 21, as seen in FIG. 1, are the same.

The lengths "l" of the top and bottom panels 11 and 12 are substantially the same. The length "l" of either the top or bottom panel minus twice the dimension "f" equals the length "L" of book K ($L=l-2f$). Thus, when the blank B is set up, as will be described hereinafter, the second panel 20 of each end wall assembly 15 will supportingly engage the corresponding end of the book K.

Connected by foldlines 23 to opposite ends of side panel 13 are first tuck flaps 24. Closure panels 25 are connected by foldlines 26 to opposite ends of bottom panel 12. As seen in FIG. 1, corresponding foldlines 17, 23 and 26 at opposite ends of panels 11, 13 and 12 are disposed in substantial coaxial alignment. Foldably connected to the outer edges of each closure panel is a retaining flap 27 which is adapted to be secured to the exposed surface of the top panel 11, see FIG. 5, when the blank is set up to form the container 10.

A second tuck flap 28 is connected by a foldline 30 to one side of each closure panel 25 and one end of the flap is separated by a cut 29 from the adjacent side panel 14, see FIG. 1. The opposite side of each closure panel is separate from the corresponding first tuck flap 24 by an elongate slot 31, see FIG. 1. A similar slot 32 separates the first tuck flap 24 from the corresponding end wall assembly 15. The dimension "Q" of each second tuck flap 28 is slightly less than the dimension "f" of either narrow panel 16 or 21. The dimension "n" of each second tuck flap 28 corresponds substantially to the dimension "e" of panel 20 of the corresponding end wall assembly 15. The function of the second tuck flaps 28 is to contribute container strength in the direction of dimension "n", and thus, reinforce the corners and edges formed by side panel 14 and closure panels 25, and protect against stacking or drop damage.

Connected by a foldline 33 to the distal edge of side panel 14 is a second retaining flap 34.

A conventional tear strip J is preferably formed on retaining flap 27 and provides a convenient way for the book purchaser to open an end of the container and gain access to the accommodated book K. The tear strip is narrow and may be formed by a pair of parallel perforated scorelines, one perforated scoreline being coincident to the foldline 26. Only the portion 27*a* of flap 27 which is disposed outwardly of strip J, as shown in FIG. 1, is adhesively secured to the exposed surface of top panel 11 thus, enabling the tear strip J, to be readily removed manually from the container when desired. The tear strip J and its function are well known in the packaging art.

As seen in FIG. 1 the second panel 20 of each end wall assembly 15 may be provided with a pair of cut scorelines 35. Each scoreline 35 is set-in a predetermined distance from the corresponding side edge of panel 20 thereby forming a breakaway tab 36 which automatically separates or deflects from the remainder of the panel 20 in the event the loaded container 10 should fall and lad on the corner of the container adjacent one of the tabs 36. Thus, the shock to the corner of the loaded container when it strikes the floor or solid surface is absorbed by the tab 36 rater than the book causing the tab to rupture and thus, prevent damage to or defacement of the adjacent corner of the accommodated book.

Figure 2:
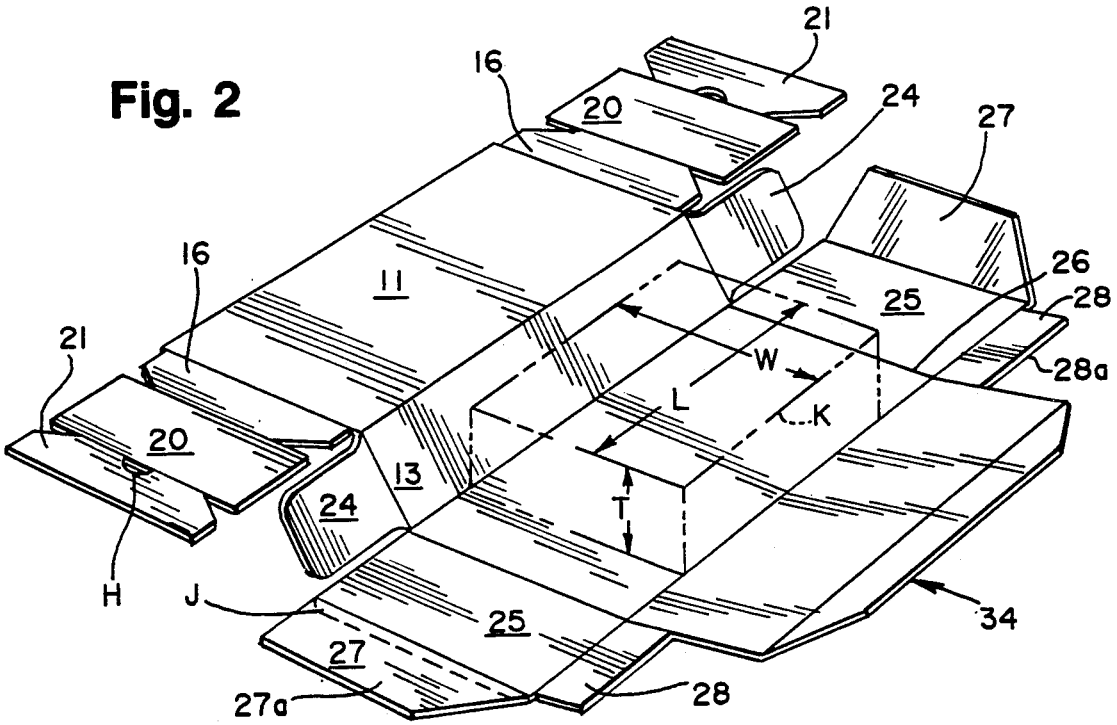

When setting up blank B to accommodate the book K, the latter is first spot-positioned so that either the front, or back, surface thereof engages in face to face relation, the concealed surface of the bottom panel 12, see FIG. 2. When the book is properly positioned on panel 12, the bound edge of the book is aligned with either the foldline connecting the bottom panel to the side panel 13 or to the side panel 14. When this occurs, the unbound edge of the book will be aligned with the remaining foldline connecting the other side panel. The ends of the book are equally spaced from the foldlines 26, see FIG. 2.

Once the book is in place on the concealed surface of the back panel 12, the side panel 13 is folded to an upright position wherein it supportingly engages the adjacent side of the book. As side panel 13 is folded upright the top panel and associated end wall assemblies 15 are simultaneously folded as a unit so that top panel 11 supportingly engages the exposed surface (either front or back) of book K. Each end wall assembly is then folded independently of the top panel so that (a) the narrow first panel 16 is folded under the top panel and engages a concealed surface thereof; (b) the second panel 20 is folded relative to the first panel so as to be transverse to the top and bottom panels and abuttingly engage the adjacent end of the book; and (c) the narrow third panel 21 is folded relative to panel 20 and engages the concealed surface of the bottom panel, see FIG. 3. Both narrow panels 16 and 21 span the distance from the book-abutting panel 20 and the adjacent corresponding edges of the top and bottom panels. A finger hole H to be hereinafter described may be provided in narrow panel 21.

After each end wall assembly has assumed its folded position as described, the tuck flaps 24 are folded inwardly relative to side panel 13 so as to assume a spaced, substantially parallel relation with the second panel 20 of the adjacent prefolded end wall assembly 15. Each closure panel 25 and associated flaps 27 and 28 are folded as a unit relative to the bottom panel 12 and the retaining flaps 27 adhesively secured to the exposed surface of the prefolded top panel 11. The second tuck flap 28 connected to each closure panel 25 is folded relative thereto so as to extend towards the second panel 20 of the adjacent end wall assembly and be disposed between the top and bottom panels 11 and 12. Once the closure panels 25 and associated flaps 27 and 28 have been folded as described, the second side panel 14 and associated retaining flap 34 are folded as a unit until the side panel 14 is at right angles to the top and bottom panels whereupon the flap 34 is further folded and adhesively secured to the exposed surface of the top panel 11.

It will be noted that the adjacent edges of retaining flaps 27 and 34 are shaped so as to form attractive mitered corners M as seen in FIG. 5. The aforedescribed folding sequence results in improved line efficiency where such sequence is preformed by automatic folding equipment of conventional design.

Because of the dimension "n" of each tuck flap 28, the flap will retain the narrow panels 16 and 21 in substantially face to face engagement with the concealed surfaces of the respective top and bottom panels 11 and 12 and provide reinforcement therefor. The upright closure panel 25 prevents outward relative movement of the narrow panel 21 of the folded end wall assembly. The closure panels 25 are retained in their upright folded positions by the retaining flaps 27 which are adhesively secured to the exposed surface of top panel 11.

A cavity D is formed at each end of the container, by the end wall assembly panels 16, 20 and 21 and the closure panel 25. Each cavity is disposed endwise of the book ends and thus, protects the vulnerable ends and corners of the book. The finger hole H facilitates manual outward pulling of the end wall assembly 15 when the tear strip J has been removed providing access to the accommodated book.

Thus, an improved shipping container for books and the like has been provided which is formed from a single blank of inexpensible foldable sheet material. The container blank is of simple design and may readily be set up manually or mechanically by conventional folding equipment.

We claim:

1. A shipping container of foldable sheet material for a book or similar article comprising opposed major panels for supportingly engaging top and bottom surfaces of the book; opposed minor panels foldably interconnecting said major panels and adapted to supportingly engage side surfaces of the book; end wall assemblies foldably connected to opposite ends of one of said major panels; closure panels foldably connected to opposite ends of the other major panel; first tuck flaps foldably connected to opposite ends of one minor panel; a second tuck flap foldably connected to a side edge of each closure panel; and means for retaining said closure panels and at least one minor panel in folded relation with said one major panel; each end wall assembly including a narrow first panel foldably connected to one opposite end of said one major panel and being folded back relative thereto and proximate a concealed surface of said one major panel, a second panel foldably connected to said first panel and substantially spanning the distance between said major panels and being adapted to supportingly engage an end surface of the book, and a narrow third panel foldably connected to said second panel and engaging a concealed surface of said other major panel; the panels of each end wall assembly cooperating with an adjacent closure panel to form a cavity for disposition endwise of the book end surface; the first tuck flap and the second tuck flap being disposed within each cavity, each second tuck flap substantially spanning the distance between the first and third panels forming the cavity and having an edge proximate the second panel forming the cavity.

2. The shipping container of claim 1 wherein an elongate edge of the narrow third panel of each end wall assembly is in substantial abutting engagement with a concealed surface of an adjacent closure panel.

3. The shipping container of claim 1 wherein the second panel of each end wall assembly is provided with a pair of substantially parallel laterally spaced weakened scorelines, each scoreline being spaced a predetermined distance from a side edge of said second panel and forming a narrow tab.

4. The shipping container of claim 1 wherein the retaining means for the one minor panel includes an elongate tear strip for opening the container.

5. The shipping container of claim 1 wherein the third panel of each end wall assembly includes a finger opening.

6. A shipping container of foldable sheet material for a book or similar article comprising a bottom major panel for subtending and supportingly engaging a back surface of the book; a top major panel in substantially parallel, spaced relation with said bottom panel for overlying and supportingly engaging a front surface of the book; a pair of elongate side minor panels in spaced substantially parallel relation for supportingly engaging corresponding side surfaces of the book, said side panels foldably interconnecting corresponding side edges of said major panels; a pair of first tuck flaps foldably connected to opposite end edges of one side minor panel and extending substantially transversely inwardly therefrom, a second side minor panel having a first retaining flap foldably connected to an elongate edge thereof and being secured in overlying relation with an exposed surface of one major panel; a pair of end wall assemblies disposed at opposite end edges of a second of the major panels, each end wall assembly including a narrow first panel foldably connected to an end edge of said second major panel and being folded back thereunder, a second panel foldably connected to said first panel and being substantially transversely disposed relative to said first panel and substantially spanning the distance between said major panels, said second panel being adapted to supportingly engage an adjacent end surface of the book; and a narrow third panel foldably connected to said second panel and being in substantially face to face relation with a concealed surface of said one major panel; a pair of end closure panels foldably connected to opposite end edges of said second major panel and extending transversely upwardly therefrom, each closure panel being in spaced relation with the second panel of the adjacent end wall assembly and cooperating therewith to form a cavity for disposition endwise of the book end surface; a second retaining flap foldably connected to each closure panel and being secured in overlying relation to the one major panel exposed surface; and a second tuck flap foldably connected to one side edge of each closure panel and extending inwardly therefrom into the adjacent cavity and substantially spanning the distance between the first and third panels of said end wall assembly, an edge of each second tuck flap being proximate the second panel of the adjacent end wall assembly.

7. The shipping container of claim 1 wherein the retaining means for said closure panels and the one minor panel includes foldable glue flaps adhesively secured to an exposed surface of said one major panel, said glue flaps cooperating with one another and forming mitered corners.

8. A blank of foldable sheet material for forming a shipping container for a book or similar article said blank comprising a first major panel; a second major panel arranged in spaced side by side relation with said first major panel; a first minor panel interposed said major panels and foldably connected thereto; a second minor panel arranged in spaced side by side relation with said first minor panel and being foldably connected to said second major panel, the latter being interposed said minor panels; a pair of end wall assemblies disposed at opposite ends of said first major panel, each end wall assembly including a narrow first panel having an elongate edge connected to an end edge of the first major panel by a first foldline disposed substantially transverse to the folding connection between said first major panel and said first minor panel, a second panel foldably connected to an opposite elongate edge of said first panel by a second foldline, and a narrow third panel having an elongate edge connected by a third foldline to the second panel and disposed opposite said first panel, the distance between said second and third foldlines being substantially equal to the distance between the folding connections of said major panels to said first minor panel; first tuck flaps foldably connected to opposite end edges of said first minor panel, substantial coaxial to said first foldlines, each first tuck flap having opposing side edges substantially parallel to each other and to the folding connections between the first minor panel and the major panels, one side edge of each first tuck flap being separated by a slot from an adjacent first end edge of one of a pair of closure panels foldably connected to opposite end edges of said second major panel; each closure panel having a laterally extending second tuck flap foldably connected to a second end edge opposite said first end edge; and retaining flaps foldably connected to said closure panels and said second minor panel; when said blank is set up to form the shipping container, said retaining flaps being secured to an exposed surface of the first major panel, and each end wall assembly, corresponding closure panel and corresponding first and second tuck flaps cooperate with one another to form a cavity separating the closure panel from the second panel of the corresponding end wall assembly.

9. The blank of claim 8 wherein the second panel of each end wall assembly includes a pair of laterally spaced substantially parallel weakened scorelines, each scoreline being spaced a predetermined distance from an adjacent side edge of said second panel and forming a narrow tab.

* * * * *

UNITED STATES PATENT AND TRADEMARK OFFICE

CERTIFICATE OF CORRECTION

PATENT NO. : 5,106,013

DATED : April 21, 1992

INVENTOR(S) : James D. Southwell, et al

It is certified that error appears in the above-identified patent and that said Letters Patent is hereby corrected as shown below:

Col. 3, line 58, delete "lad" and substitute therefor --land--

Col. 3, line 61, delete "rater" and substitute therefor --rather--

Col. 6, line 45, after "article" insert --,--

Col. 6, line 68, after "panel" insert --each first tuck-flap having a folding axis--

Signed and Sealed this

Sixth Day of July, 1993

*Attest:*

Michael K. Kirk

MICHAEL K. KIRK

*Attesting Officer*

*Acting Commissioner of Patents and Trademarks*